United States Patent [19]

Saam

[11] 4,077,594

[45] Mar. 7, 1978

[54] CHAIR LEG BASE

[75] Inventor: Charles W. Saam, Ohio City, Ohio

[73] Assignee: Harter Corporation, Sturgis, Mich.

[21] Appl. No.: 770,584

[22] Filed: Feb. 22, 1977

Related U.S. Application Data

[62] Division of Ser. No. 673,312, Apr. 5, 1976, Pat. No. 4,027,364.

[51] Int. Cl.[2] ..... F16M 11/20

[52] U.S. Cl. ..... 248/188.7; 248/188.8

[58] Field of Search ..... 248/188.7, 188.8, 431

[56] References Cited

U.S. PATENT DOCUMENTS

| | | | |
|---|---|---|---|
| 2,913,208 | 11/1959 | McKinley | 248/188.7 |
| 3,617,023 | 11/1971 | Schneiderman | 248/188.7 |
| 3,674,230 | 7/1972 | Propst | 248/188.8 |
| 3,682,425 | 8/1972 | Vincent | 248/188.7 |
| 3,705,704 | 12/1972 | Textoris | 248/188.7 |

*Primary Examiner*—Roy D. Frazier
*Assistant Examiner*—Peter A. Aschenbrenner
*Attorney, Agent, or Firm*—Hamilton, Renner & Kenner

[57] ABSTRACT

A tapered tubular chair base leg is formed from a tube of uniform cross section throughout its length by deforming the bottom wall and adjoining portions of the sidewalls of the tube inwardly to produce an interior rib which is inclined throughout its length relative to the longitudinal axis of the tube. The smaller end of the formed tube is then formed to close the end and provide a downwardly open bore for frictionally embracing a tubular caster-mounting bushing.

5 Claims, 10 Drawing Figures

12
15
13
15
14

12a 4
13'
15'
14'
X
4
12

13'
14'
15'

6
13'
15'
14'a
X
6
22
21
12'

21
14'a
15'
20
22
22
13'
15'

CHAIR LEG BASE

This is a division of application Ser. No. 673,312, filed Apr. 5, 1976, now U.S. Pat. No. 4,027,364.

BACKGROUND OF THE INVENTION

The base of a conventional swivel chair comprises a plurality of legs radiating from a central hub having a pivot post extending vertically upward and supporting the chair seat at its upper end. The legs are preferably tapered to provide an aesthetic appearance and good structural design and have been made of various materials including wood and metal, the wood legs being relatively bulky in order to provide adequate strength.

Tapered tubular legs formed from sheet metal have been provided to reduce size and cost while providing adequate strength and pleasing appearane. A conventional method of making a tapered tubular leg is to start with a flat sheet metal blank tapered longitudinally with tabs at its smaller end, form flanges at 90° along the outer longitudinal edges of the blank each equal in depth to one-half the thickness of the finished tube, then fold the blank through 180° to form parallel tapered side walls and bring the edge flanges into edgewise abutment, seam weld the abutting edges together, and then bend the end tabs around a tubular caster-supporting bushing and weld the tabs thereto.

SUMMARY OF THE INVENTION

The present invention utilizes a preformed tube which is uniform in cross section throughout its length and has parallel side walls and top and bottom walls that may be flat or convexly curved The bottom wall is deformed inwardly upward and angularly and the adjoining side wall portions folded inwardly to form an interior rib inclined with respect to the longitudinal axis of the tube, with the outer edges of the bottom wall also inclined, resulting in a tapered tube. Before forming the interior rib, the end of the preformed tube which is to become the smaller end is cut off to leave an upper extension designed to be stretched into a closed end wall adapted to receive a caster-mounting bushing which is embraced on the opposite side by the end of the formed interior rib.

It is an object of the present invention to provide a novel and improved method of forming a tapered tubular reinforced base leg for a swivel chair from a straight preformed tube.

Another object is to provide an improved method of forming a tapered tubular leg from a straight preformed tube which provides an interior longitudinally inclined reinforcing rin in the bottom wall of the leg.

A further object is to provide an improved method of forming a tapered tubular reinforced leg from a straight preformed tube which includes first cutting of the straight tube at one end to provide a portion to be stretched into a closed end wall for the tapered tube.

Another object is to provide an improved method of forming a tapered tubular leg from a straight preformed tube which includes forming a bore at the smallr end of the tapered tube for embracing a caster-mounting bushing disposed at right angles to the bottom wall of the tube.

Still another object is to provide a novel and improved tapered tubular chair leg having an inclined interior rib in the bottom wall of the tube and a closed end wall as its smaller end adapted to embrace one side of a caster-mounting bushing disposed at right angles to said bottom wall and abutting the end of said rib.

These and other objects are accomplished by the improvements comprising the present invention, preferred embodiments of which are shown by way of example in the accompanying drawings, and described in detail in the following specification. Various modifications and changes in details of construction are comprehended within the scope of the appended claims.

DESCRIPTION OF PREFERRED EMBODIMENT

The improved method will be described with respect to the form of preformed tube indicated generally at 12 in FIG. 1, but it will be understood that the method is equally applicable to the tube 12*a* of FIG. 2. The tube 12 has a curved top wall 13, a curved bottom wall 14, and preferably flat side walls 15. Preformed tubes of other modified cross sections may also be used.

Figures 1, 2, 3, 4, 5, 6:
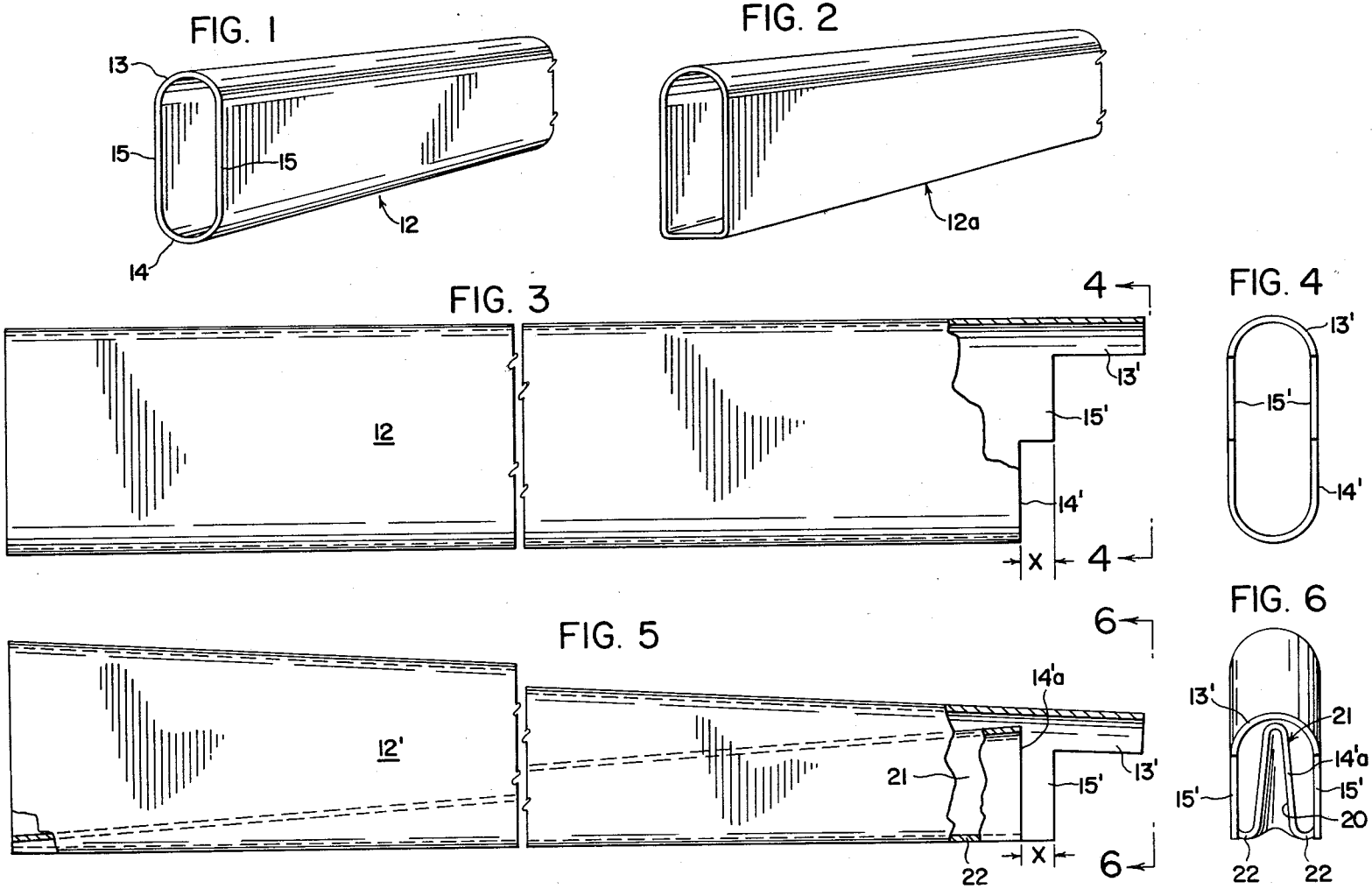
FIG. 1 is a partial perspective view of one embodiment of a preformed tube of uniform cross section from which a tapered chair leg is formed according to the improved method.
FIG. 2 is a similar view of a preformed tube of modified cross section.
FIG. 3 is an enlarged side elevation of the tube of FIG. 1, partly broken away, with one end cut off ultmately to be formed into a closed end receiving a caster-mounting bushing.
FIG. 4 is an end elevation on line 4—4 of FIG. 3.
FIG. 5 is a side elevation of the tube of FIG. 3 after the bottom wall and adjoining side wall portions have been deformed upwardly and angularly to form the interior longitudinally inclined rib.
FIG. 6 is an end elevation on line 6—6 of FIG. 5.

The first step in the improved method is to cut off one end of the tube 12 in stepped formation as shown in FIG. 3 to form an upper inverted U:shapd extension 13', a lower U-shaped end 14', and intermediate side wall extensions 15' extending a distance X beyond the end 14'. By reference to FIGS. 7–10, it will be seen that the extension 13' is adapted subsequently to be stretched and bent downwardly substantially at 90° to bring is side edges into abutment with the end edges of extensions 15' for welding thereto to form a curved closed end wall 13'*a* which receives and embraces the upper reduced thimble portion 18 of a bushing 19 which is adapted to mount a caster (not shown). The end wall 13'*a* embraces substantially one-half the circumference of thimble 18.

After the end of tube 12 has been cut off as shown in FIG. 3, the bottom wall 14 and adjoining portions of side walls 15 are deformed inwardly and angularly upward to form a reentrant groove 20 and an interior longitudinal rib 21 which is inclined relative to the longitudinal axis of the tube and which has its greatest height at the cut-of end of the tube. This deforming operation produes curved bottom edges 22 connecting the side walls 15 to the interior rib 21, and extending longitudinally at an angle to the orignal longitudinal axis of the tube, thus producing a longitudinally tapered tube, as shown in FIG. 5, with rib 21 longitudinally inclined relative to both the top and bottom walls of the tube.

Figures 7, 8, 9, 10:
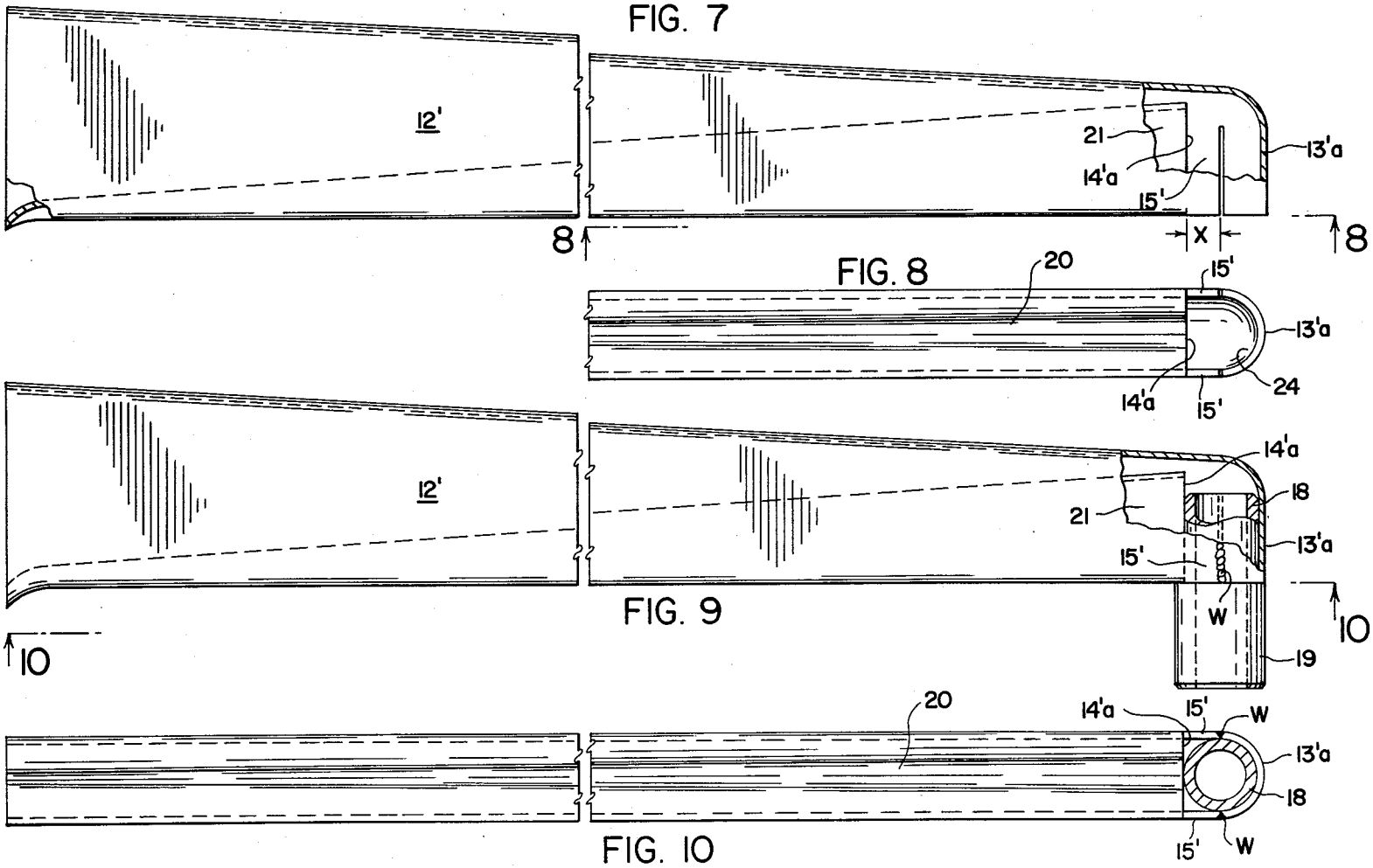
FIG. 7 is a side elevation similar to FIG. 5, showing the upper portion of the cut-off end bent downwardly to form a closed end wall.
FIG. 8 is a partial bottom elevation on line 8—8 of FIG. 7.
FIG. 9 is a side elevation similar to FIG. 7 showing a caster-mounting bushing received within the closed end wall and abutting the end of the interior inclined rib.
FIG. 10 is a bottom elevation on line 10—10 of FIG. 9.

The end 14'*a* of the formed rib 21 remains at the same distance X from the ends of the side wall extensions 15', and the distance X is preferably equal to one-half the outer diameter of thimble 18 of bushing 19, so that when the closed end wall 13'*a* is formed to embrace one-half of the circumference of the thimble, the end 14'*a* of the formed rib 21 will abut the thimble opposite to the end wall, as shown in FIGS. 9 and 10.

After forming the rib 21 in the manner described, and as shown in FIGS. 5 and 6, the curved upper extension 13' is stretched and bent downwardly as shown in FIGS. 7 and 8 to form the closed end wall 13'*a* with a bottom opening 24 defined between the curved end wall 13'*a* and the end 14'*a* of the rib 2. The axis of said opening is substantially at right angles to the bottom of the side walls as now defined by the longitudinally extending curved bottom edges 22, so that the axis of the bushing 19 when inserted will also be perpendicular thereto.

After the extension 13'*a* is bent and stretched to the position shown in FIG. 7, its inner edges are then in substantial abutment with the ends of side wall extensions 15', and are welded or brazed thereto as indicated at W in FIGS. 9 and 10.

The thimble 18 of the bushing 19 is then inserted as shown in FIGS. 9 and 10, and a snug fit is provided between the end wall 13'*a* and the end 14'*a* of rib 21. If desired, a tack weld between the thimble 18 and end 14'*a* of rib 21, may be applied from within the reentrant groove 20.

The improved method provides for using preformed tubes rather than blanking, forming and welding sheet metal, provides simple cutting and forming operations, and minimal welding. The improved deforming operation automatically provides a desired tapered shape and a reinforced construction.

The resulting product is stong, light weight, pleasing in appearance, and provides a snug mounting for a caster-supporting bushing.

I claim:

1. A tapered tubular chair leg having a top, bottom and side walls, said bottom wall having a reentrant groove forming an interior rib inclined with respect to said top and bottom walls and gradually increasing in height toward the smaller end of said tube, said rib being formed at said smaller end to embrace one side of a caster-mounting bushing disposed at right angles to said bottom wall.

2. A tapered tubular chair leg having one end smaller than the other and integral top, bottom and side walls, said bottom walls having a longitudinal reentrant groove forming an interior rib inclined with respect to said top and bottom walls and gradually increasing in height toward the smaller end of the tube, and said smaller end having a closed end wall.

3. A tapered tubular chair leg as defined in claim 2, wherein said rib terminates short of said end wall to define a bushing receiving bottom opening adjacent thereto.

4. A tapered tubular chair leg as defined in claim 3, wherein said rib is adapted to embrace one side of a bushing within and contacting said end wall.

5. A tapered tubular chair leg as defined in claim 4, wherein said end wall is curved, and a circular bushing is inserted between said end wall and the adjacent end of said interior rib.

* * * * *